US006536441B2

(12) United States Patent
Chuan

(10) Patent No.: US 6,536,441 B2
(45) Date of Patent: Mar. 25, 2003

(54) COMPOSITE CIGAR PORTABLE STRUCTURE

(76) Inventor: Chin-Chung Chuan, No. 183, Sec.2, Shu-Lin St., Tainan City (TW)

( * ) Notice: Subject to any disclaimer, the term of this patent is extended or adjusted under 35 U.S.C. 154(b) by 2 days.

(21) Appl. No.: 09/932,507

(22) Filed: Aug. 20, 2001

(65) Prior Publication Data

US 2003/0034041 A1 Feb. 20, 2003

(51) Int. Cl.[7] ..... A24F 13/02; B65D 85/12; B65D 85/10

(52) U.S. Cl. ..... 131/187; 131/190; 131/191; 206/242; 220/4.28; 220/4.01; 220/4.31

(58) Field of Search ..... 131/330, 175, 131/187, 190, 191; 206/242, 253, 257, 262, 265, 266; 220/4.01, 4.28, 4.31

(56) References Cited

U.S. PATENT DOCUMENTS 2,370,800 A * 4/1945 Sterns ..... 220/586
4,046,279 A * 9/1977 Rosler ..... 220/8
4,210,253 A * 7/1980 Rosler ..... 220/8
4,596,340 A * 6/1986 Luther ..... 220/8
4,637,407 A * 1/1987 Bonanno et al. ..... 131/175
4,819,666 A * 4/1989 Turver ..... 131/175
5,605,242 A * 2/1997 Hwang ..... 220/8
6,290,059 B1 * 9/2001 Chuan ..... 206/238

* cited by examiner

*Primary Examiner*—Steven P. Griffin
*Assistant Examiner*—Carlos Lopez
(74) *Attorney, Agent, or Firm*—Charles E. Baxley

(57) ABSTRACT

A composite cigar portable structure includes a cigar tube, an end cap, a connecting tube, an elastic plate, a retaining ring, a combination member, and a lighter. Thus, the composite cigar portable structure may contain a cigar tube for receiving the cigar, and a lighter for lighting the cigar. In addition, the cigar tube may be used individually to receive the cigar, and the lighter may also be used individually, thereby enhancing the versatility of the composite cigar portable structure.

4 Claims, 5 Drawing Sheets

COMPOSITE CIGAR PORTABLE STRUCTURE

BACKGROUND OF THE INVENTION

1. Field of the Invention

The present invention relates to a composite cigar portable structure, and more particularly to a composite cigar portable structure which contains a cigar tube for receiving the cigar, and a lighter for lighting the cigar.

2. Description of the Related Art

A conventional cigar case may be used to receive the cigar, and is made portable with a compact size, so that a user may carry it conveniently. The conventional cigar case is hard, thereby preventing the cigar from being compressed, and has a pretty configuration, thereby enhancing the aesthetic quality thereof. However, the conventional cigar case can be used to receive the cigar only, so that the user has to carry a lighter additionally, thereby greatly limiting the versatility of the conventional cigar case.

SUMMARY OF THE INVENTION

The present invention has arisen to mitigate and/or obviate the disadvantage of the conventional cigar case.

The primary objective of the present invention is to provide a composite cigar portable structure which contains a cigar tube for receiving the cigar, and a lighter for lighting the cigar.

Another objective of the present invention is to provide a composite cigar portable structure, wherein the cigar tube may be used individually to receive the cigar, and the lighter may be used individually, thereby enhancing the versatility of the composite cigar portable structure.

In accordance with the present invention, there is provided a composite cigar portable structure, comprising:

- a cigar tube, receiving a cigar therein, the cigar tube having two ends whose wall faces are formed with first and second openings which are formed with threads;
- an end cap, screwed on the first opening of the cigar tube, thereby closing the first opening of the cigar tube;
- a connecting tube, slidably mounted in the second opening of the cigar tube, and having an outer wall formed with a mounting face which has two ends formed with flanges, the connecting tube having one end formed with a connecting portion which is formed with threads;
- an elastic plate, having an outward expanding elastic force, and having a surface formed with multiple concave portions and convex portions, the elastic plate mounted on the mounting face of the connecting tube, and has two ends limited by the flanges of the mounting face, the convex portions of the elastic plate contacting an inner wall of the cigar tube so that the connecting tube may slide in the cigar tube with a proper tension applied by the elastic plate;
- a retaining ring, screwed in the second opening of the cigar tube, and formed with a retaining flange rested on an end face of the second opening of the cigar tube, thereby preventing the connecting tube from moving outward from the cigar tube;
- a combination member, having two ends respectively formed as a combination portion and a joint portion arranged in a stepwise manner, the combination portion of the combination member screwed in the connecting portion of the connecting tube; and

- a lighter, having a bottom screwed on the joint portion of the combination member.

Further benefits and advantages of the present invention will become apparent after a careful reading of the detailed description with appropriate reference to the accompanying drawings.

DETAILED DESCRIPTION OF THE INVENTION

Figure 1:
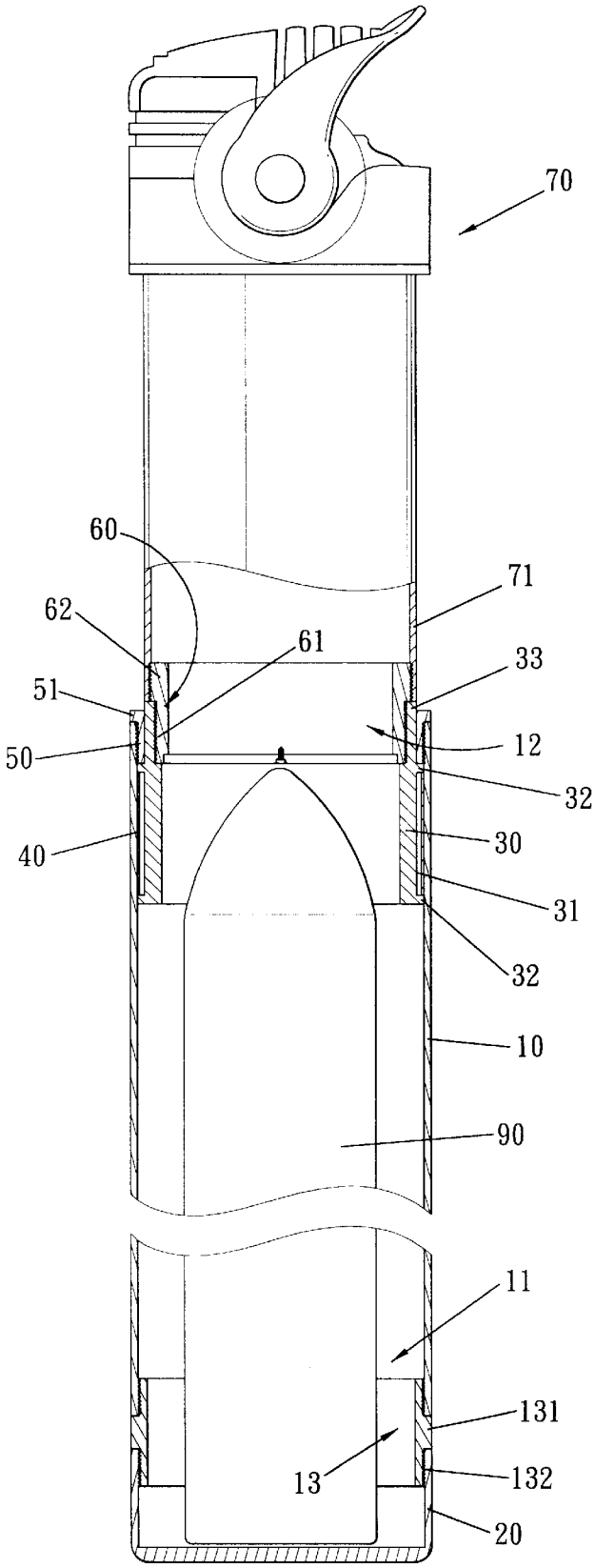
FIG. 1 is a cross-sectional assembly view of a composite cigar portable structure in accordance with the present invention.
Figure 2:
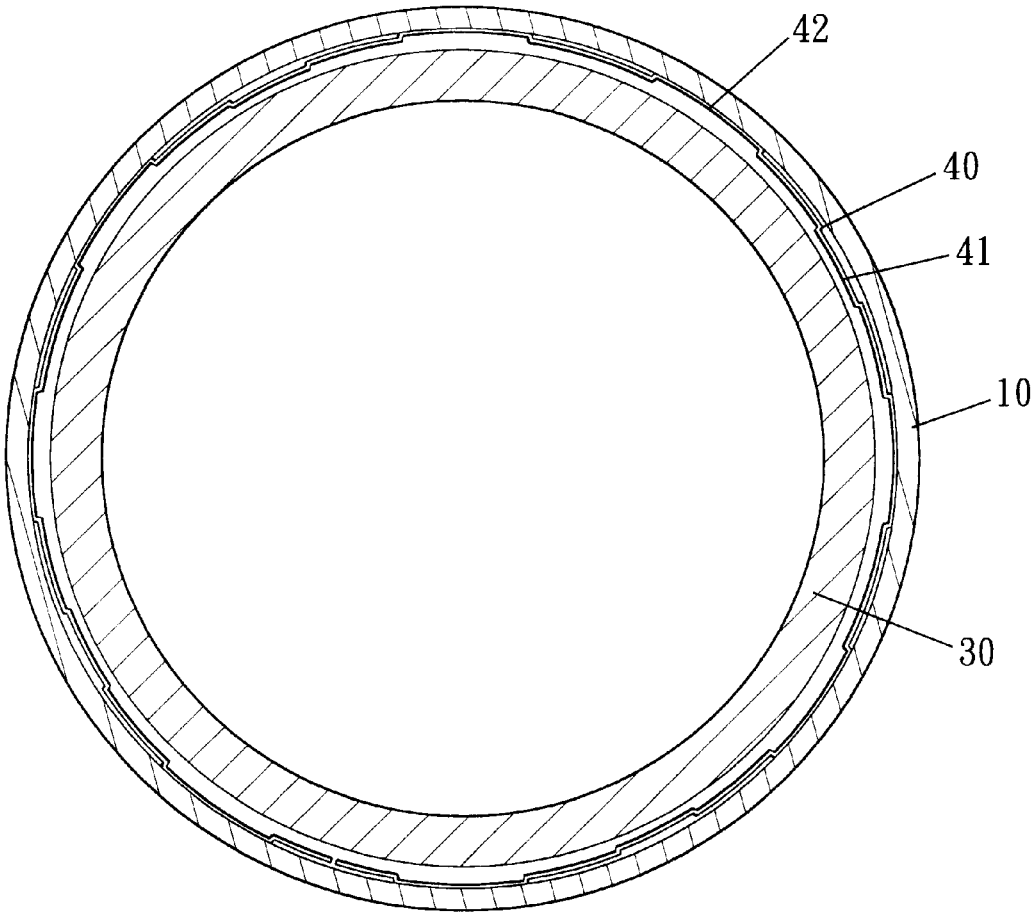
FIG. 2 is a top plan cross-sectional view of the composite cigar portable structure as shown in FIG. 1.
Figure 3:
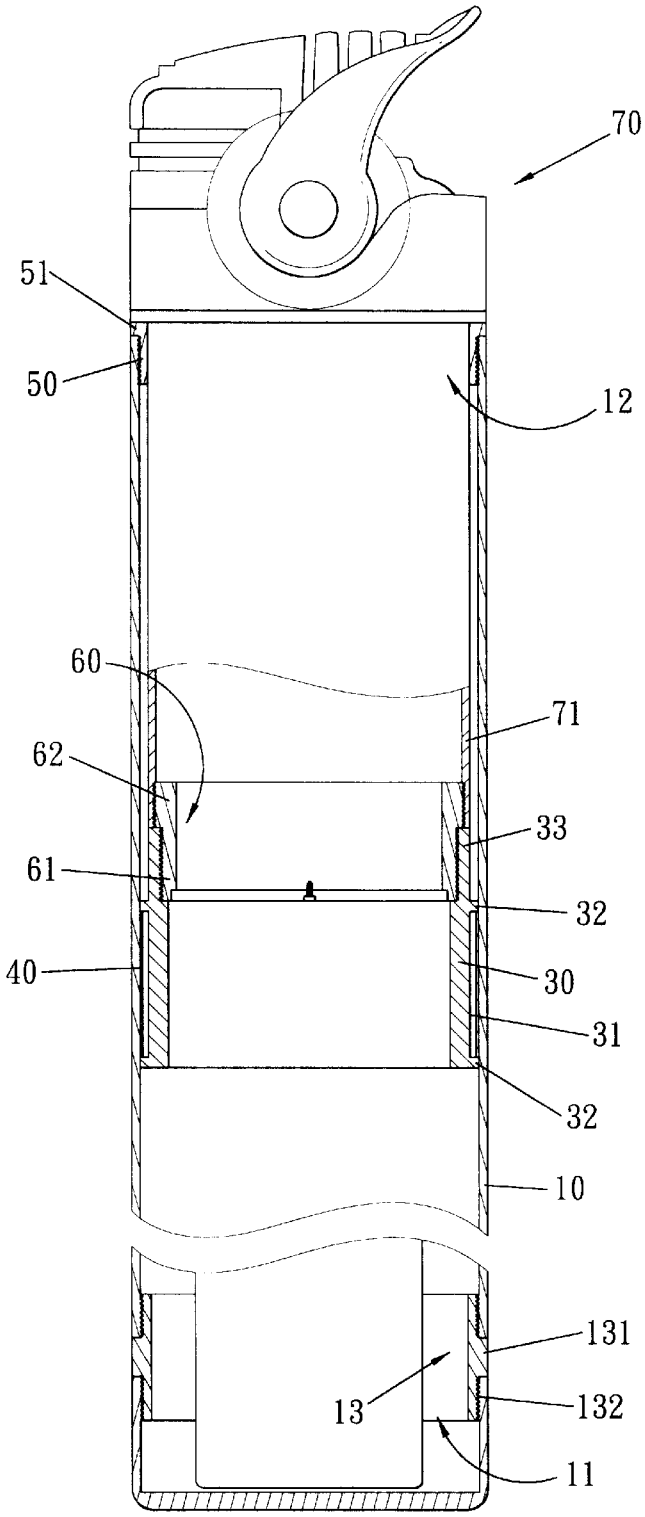
FIG. 3 is a schematic operational view of the composite cigar portable structure as shown in FIG. 1 when not in use.

Referring to the drawings and initially to FIGS. 1–3, a composite cigar portable structure in accordance with a preferred embodiment of the present invention comprises a cigar tube 10, an end cap 20, a connecting tube 30, an elastic plate 40, a retaining ring 50, a combination member 60, and a lighter 70.

The cigar tube 10 may receive a cigar 90 therein. The wall faces of the first and second openings 11 and 12 of the cigar tube 10 are formed with threads. An extension member 13 is screwed in the first opening 11, and is formed with a flange 131 rested on an end face of the first opening 11. A threaded tube 132 is formed on and protruded from the extension member 13.

The end cap 20 is formed with threads which may be screwed on the threaded tube 132 of the extension member 13 on the first opening 11 of the cigar tube 10, thereby closing the first opening 11 of the cigar tube 10.

The connecting tube 30 is slidably mounted in the second opening 12 of the cigar tube 10, and has an outer wall formed with a mounting face 31 which has two ends formed with flanges 32. The connecting tube 30 has one end formed with a connecting portion 33 which is formed with threads.

The elastic plate 40 has an outward expanding elastic force, and has a surface formed with multiple concave portions 41 and convex portions 42. The elastic plate 40 is mounted on the mounting face 31 of the connecting tube 30, and has two ends limited by the flanges 32 of the mounting face 31. The convex portions 42 of the elastic plate 40 contact the inner wall of the cigar tube 10, such that the connecting tube 30 may slide in the cigar tube 10 with a proper tension applied by the elastic plate 40.

The retaining ring 50 is screwed in the second opening 12 of the cigar tube 10, and is formed with a retaining flange 51 rested on an end face of the second opening 12 of the cigar tube 10, thereby preventing the connecting tube 30 from moving outward from the cigar tube 10.

The combination member 60 has two ends respectively formed as a combination portion 61 and a joint portion 62 arranged in a stepwise manner. The combination portion 61 of the combination member 60 is screwed in the connecting portion 33 of the connecting tube 30.

The lighter 70 has a bottom 71 screwed on the joint portion 62 of the combination member 60. The lighter 70 may be locally retracted into the cigar tube 10 through the connecting tube 30 and the elastic plate 40.

In practice, preferably referring now to FIG. 1, the lighter 70 may be protruded outward from the second opening 12 of the cigar tube 10, and the end cap 20 may be unscrewed and removed from the cigar tube 10, so that the cigar 90 may be placed into the first opening 11 of the cigar tube 10. Then, the end cap 20 may be screwed on the cigar tube 10 again, thereby completing the work for receiving the cigar 90.

In use, the end cap 20 may be unscrewed from the cigar tube 10, so that the cigar 90 may be taken out from the first opening 11 of the cigar tube 10, to be lighted by the lighter 70 directly. Afterwards, the lighter 70 may be pushed toward the second opening 12 of the cigar tube 10 by co-operation of the connecting tube 30 and the elastic plate 40, so that the lighter 70 may be locally received in the cigar tube 10 as shown in FIG. 3, with the head of the lighter 70 being exposed outward from the cigar tube 10, thereby largely shortening the entire volume for facilitating the user carrying the composite cigar portable structure.

Figure 4:
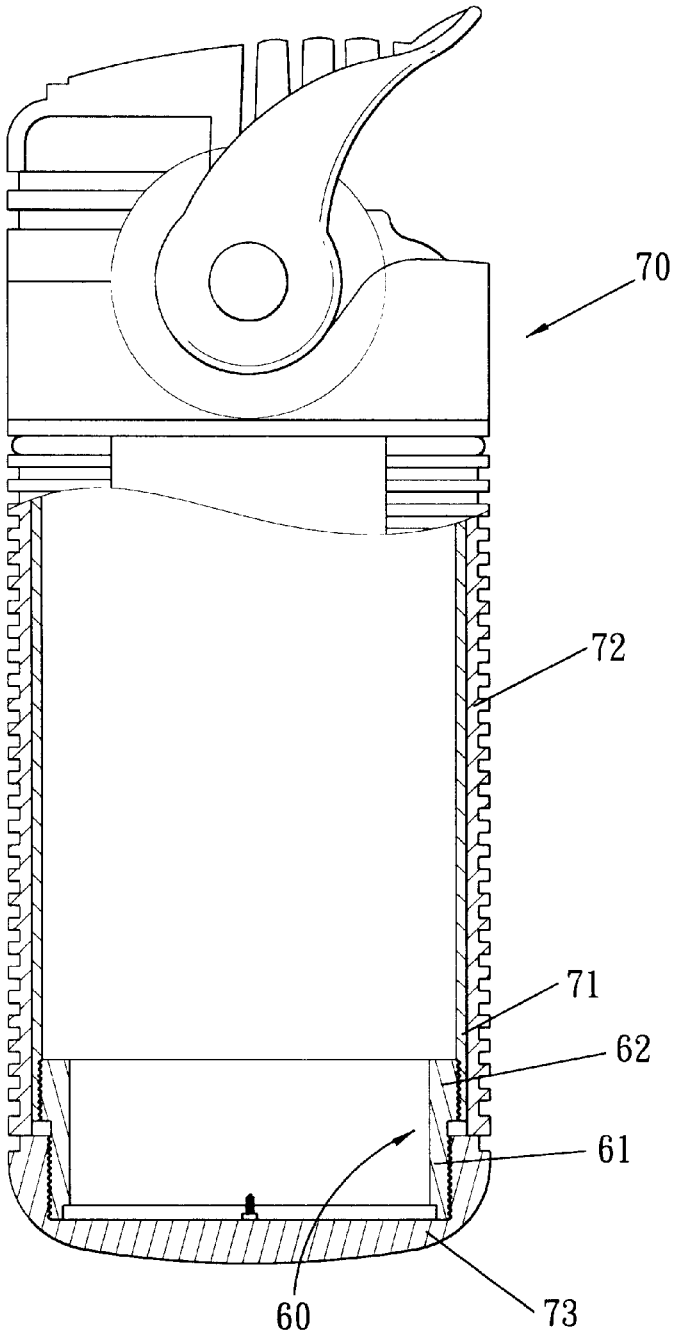
FIG. 4 is a cross-sectional assembly view of the composite cigar portable structure in accordance with another state of the present invention.

Referring to FIG. 4, the combination member 60 may be unscrewed from the connecting tube 30, thereby removing the lighter 70 from the cigar tube 10. Then, an outer mounting tube 72 may be mounted on the outside of the lighter 70, and a bottom cap 73 may be screwed on the combination portion 61 of the combination member 60, to combined and limit the outer mounting tube 72, so that the lighter 70 may be used individually.

Figure 5:
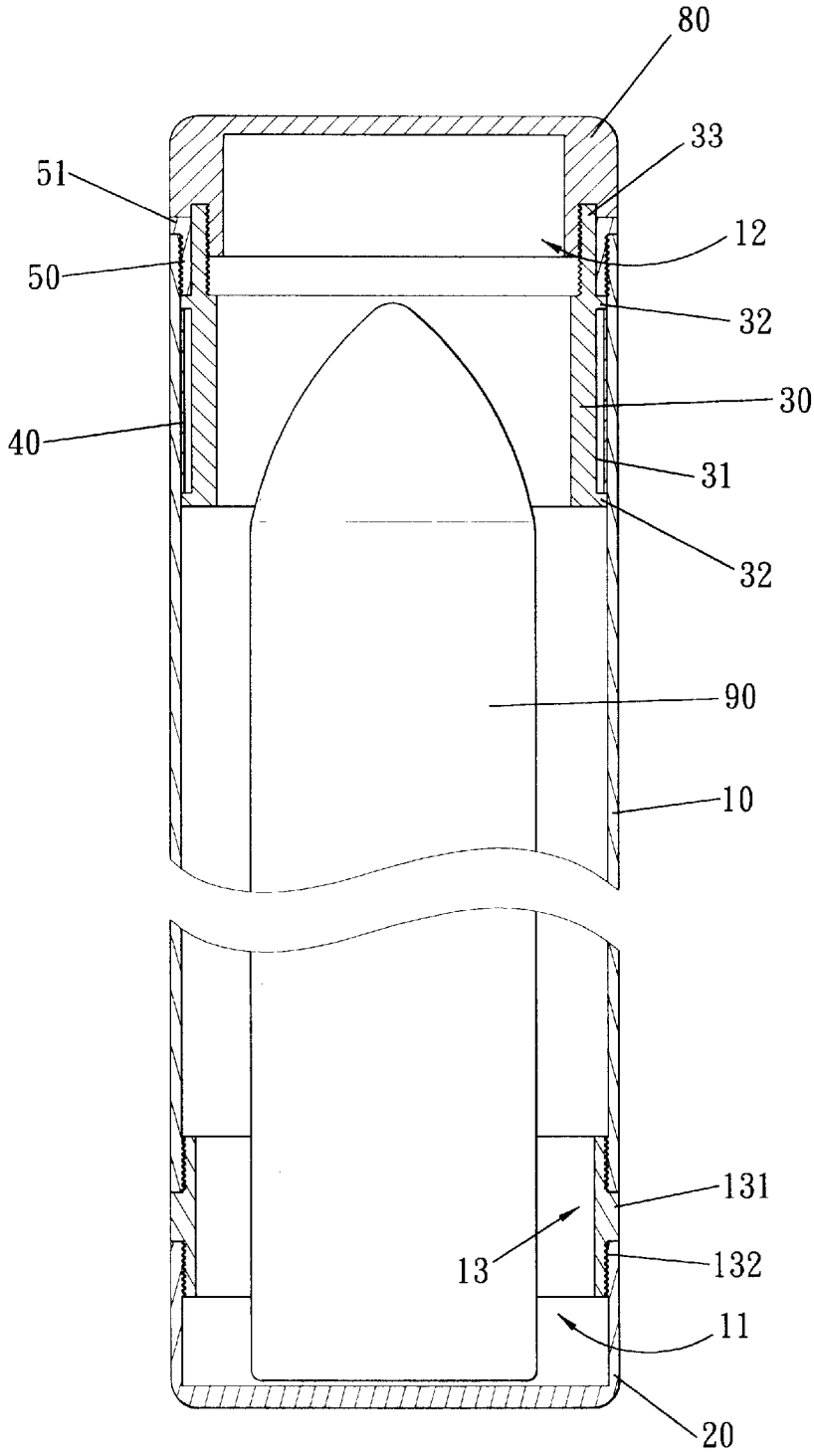
FIG. 5 is a cross-sectional assembly view of the composite cigar portable structure in accordance with another state of the present invention.

Referring to FIG. 5, after the lighter 70 and the combination member 60 are separated from the connecting tube 30, a cover 80 may be screwed on the connecting tube 30, thereby closing the second opening 12 of the cigar tube 10, so that the cigar tube 10 may be used individually to receive the cigar 90.

Accordingly, the composite cigar portable structure in accordance with the present invention may contain a cigar tube 10 for receiving the cigar 90, and a lighter 70 for lighting the cigar 90. In addition, the cigar tube 10 may be used individually to receive the cigar 90, and the lighter 70 may also be used individually, thereby enhancing the versatility of the composite cigar portable structure.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A composite cigar portable structure, comprising:

a cigar tube, receiving a cigar therein, the cigar tube having two ends whose wall faces are formed with first and second openings which are formed with threads;

an end cap, screwed on the first opening of the cigar tube, thereby closing the first opening of the cigar tube;

a connecting tube, slidably mounted in the second opening of the cigar tube, and having an outer wall formed with a mounting face which has two ends formed with flanges, the connecting tube having one end formed with a connecting portion which is formed with threads;

an elastic plate, having an outward expanding elastic force, and having a surface formed with multiple concave portions and convex portions, the elastic plate mounted on the mounting face of the connecting tube, and has two ends limited by the flanges of the mounting face, the convex portions of the elastic plate contacting an inner wall of the cigar tube and wherein the connecting tube slides in the cigar tube with a proper tension applied by the elastic plate;

a retaining ring, screwed in the second opening of the cigar tube, and formed with a retaining flange rested on an end face of the second opening of the cigar tube, thereby preventing the connecting tube from moving outward from the cigar tube;

a combination member, having two ends respectively formed as a combination portion and a joint portion arranged in a stepwise manner, the combination portion of the combination member screwed in the connecting portion of the connecting tube; and a lighter, having a bottom screwed on the joint portion of the combination member.

2. The composite cigar portable structure in accordance with claim 1, wherein the combination member is unscrewed from the connecting tube, thereby removing the lighter from the cigar tube, an outer mounting tube is mounted on an outside of the lighter, and a bottom cap is screwed on the combination portion of the combination member.

3. The composite cigar portable structure in accordance with claim 1, wherein after the lighter and the combination member are separated from the connecting tube, a cover is screwed on the connecting tube, thereby closing the second opening of the cigar tube, wherein the cigar tube is capable of receiving the cigar.

4. The composite cigar portable structure in accordance with claim 1, further comprising an extension member screwed in the first opening of the cigar tube, and formed with a flange rested on an end face of the first opening, a threaded tube formed on and protruded from the extension member, wherein the end cap is screwed on the threaded tube of the extension member, thereby closing the first opening of the cigar tube.

* * * * *